United States Patent [19]

May, Jr.

[11] 4,083,572

[45] Apr. 11, 1978

[54] SKI ATTACHMENT

[76] Inventor: Clifford J. May, Jr., 29208 Glenarden, Farmington, Mich. 48024

[21] Appl. No.: 712,285

[22] Filed: Aug. 6, 1976

[51] Int. Cl.[2] ..... A63C 11/00

[52] U.S. Cl. ..... 280/11.37 E; 362/191

[58] Field of Search ..... 280/11.37 E, 11.37 A, 280/606, 601, 11.37 J, 11.37 R, 11.37 H, 11.37 B; 240/6.4 R, 6.42, 10.6 R

[56] References Cited

U.S. PATENT DOCUMENTS

| | | | |
|---|---|---|---|
| 2,245,769 | 6/1941 | Flamm | 280/11.19 |
| 2,502,566 | 4/1950 | Hooley | 280/11.37 E X |
| 2,931,012 | 3/1960 | Kosach | 280/11.24 X |
| 3,067,322 | 12/1962 | Sala | 362/103 |
| 3,295,860 | 1/1967 | Von Hoven | 280/601 |
| 3,297,862 | 1/1967 | Levy et al. | 240/10.6 R |
| 3,789,208 | 1/1974 | Lewis | 280/11.37 E X |
| 3,876,216 | 4/1975 | Wehr | 280/601 |

FOREIGN PATENT DOCUMENTS

| | | | |
|---|---|---|---|
| 188,027 | 10/1954 | Austria | 280/11.37 H |
| 533,064 | 2/1941 | United Kingdom | 280/11.37 E |

*Primary Examiner*—Joseph F. Peters, Jr.
*Assistant Examiner*—Milton L. Smith
*Attorney, Agent, or Firm*—Cullen, Settle, Sloman & Cantor

[57] ABSTRACT

A ski attachment device having safety, functional and decorative features. The ski attachment includes a sheath adapted to be retainably received over the tip of the ski, a battery-powered light, and a housing for mounting the light on the sheath so as to aid a skier during periods when sufficient illumination is not available. The ski attachment device is particularly useful in alpine and cross-country skiing to illuminate the trail in front of the skier, to assist the skier in always knowing the position and alignment of his ski tips, and to aid other skiers in being able to see the position and direction of motion of the skier. A hood-like extension at the forward end of the housing directs a major portion of the generated light in a forward direction and an aperture in the extension allows a smaller portion of the light to be directed rearwardly and upwardly for alignment purposes.

12 Claims, 4 Drawing Figures

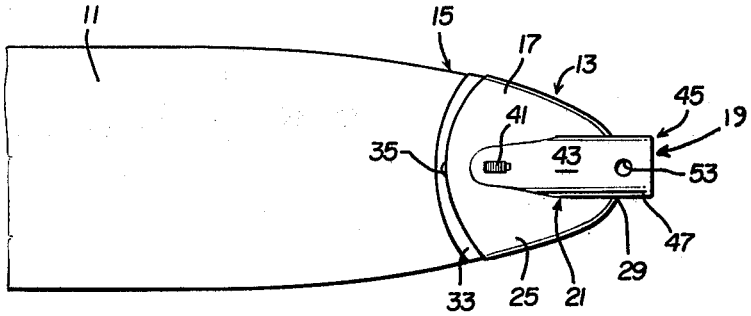
FIG. 1
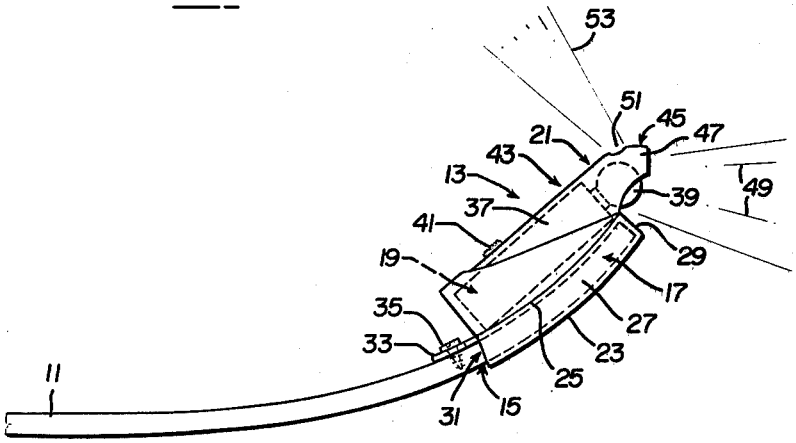
FIG. 2
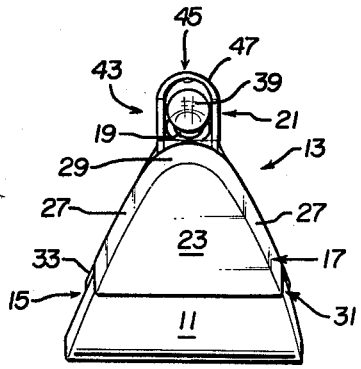
FIG. 3
FIG. 4
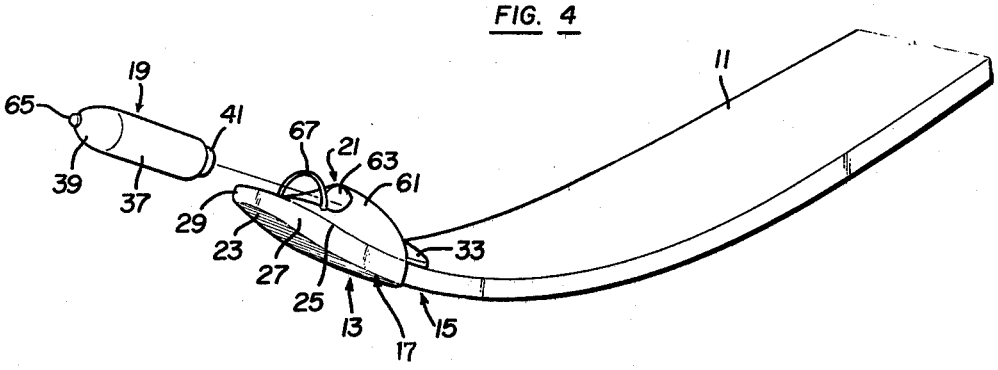

SKI ATTACHMENT

BACKGROUND OF THE INVENTION

This invention relates generally to an attachment device for a ski and more particularly to a ski light attachment which makes it easier, safer, and more colorful for skiing under less than optimum lighting conditions.

In the prior art, nighttime skiing has been relatively dangerous. Although some areas provide nighttime illumination of the slopes, darkened areas and shadows often hide hazardous conditions which interfere with optimum skiing conditions and often lead to skiing accidents. Additionally, the skiers often have problems keeping track of the tips of their skis during nighttime skiing and this can lead to hazardous skiing conditions or even accidents.

Even greater problems are encountered by cross-country skiers since few if any of the areas in which cross-country skiers operate are lighted at night. It is extremely important that cross country skiers be able to see a short distance in front of their ski tips for maximum skiing pleasure and to avoid hazards. Additionally, it is highly advantageous if the cross-country skier is able to observe the tips of his skis for alignment purposes.

None of the devices of the prior art provide such aid. Additionally, people who are skiing at night or under conditions of poor visibility are not always able to readily observe their fellow skiers for practicing the "buddy system" or for accident avoidance purposes.

The ski attachment device of the present invention solves all of these problems and provides a relatively low cost, extremely simple means whereby a skier is able to see a short distance in front of his ski tips, is able to keep track of his tips for alignment purposes and the like, and other skiers are able to more readily see the progress of a skier utilizing the device of the present invention.

SUMMARY OF THE INVENTION

The present invention provides a ski attachment device comprising a sheath adapted to be receivably retained over the tip of a ski. A battery-powered, switch-operated light is mounted on the sheath so as to aid the skier during periods when sufficient illumination is not available.

The means for mounting the light may include a protective housing having a hood at the forward end thereof for directing a major portion of the illumination generated by the light in a forward direction to light the path for a short distance in front of the ski tip thereby enabling the skier to avoid hazards and to choose an optimum line. Additionally, the hood may be provided with an alignment port or aperture adapted to direct a small percentage of the illumination generated by the light up and back toward the skier so that he can observe his ski tips at all times for alignment purposes and the like.

The sheath and housing combination may be a single integral lightweight piece of molded plastic material which is adapted to retainably receive the light in a waterproof manner within the housing or, alternatively, the light may be self-contained and be adapted to be removably retained on the sheath by the mounting means.

The ski light attachment device of the present invention is useful in both alpine and cross-country skiing. Even if the slopes are lighted, it can aid the skier in choosing an optimum line down the slopes or in observing hazardous conditions in shadowed or incompletely illuminated areas.

Cross-country skiers are able to practice their chosen sport at night for the first time since few if any cross-country sking areas are illuminated. The cross-country skier is not traveling at high speeds and if he is able to see a short distance in front of his ski tips and if he is able to observe his tips and keep his skis aligned there is nothing to prevent him from practicing safe cross-country skiing at night.

Lastly, others are able to observe and keep track of the progress of skiers utilizing the ski light attachments of the present invention. In addition to the decorative aspects involved, and in addition to the fact that the skiers are able to do that which they could not previously do and to do it more effectively, the safety aspects of the present invention should render it desirable if not essential to all nighttime skiers.

Furthermore, the present invention will find use under less than optimal lighting conditions, night or day, such as during a snow storm or under twilight or shadowy conditions. Since the ski light attachment device of the present invention is relatively light, it does not affect the balance of the ski and since it is easily removable, it could be removed during daytime use and reinstalled when conditions required. The ski light attachment does not interfere with normal skiing even if it is left on continuously.

The ski attachment device of the present invention will enable skiers to ski in areas and in conditions under which they could not previously ski. They are able to ski more effectively and more safely resulting in fewer accidents to the skiers utilizing the attachments and to fellow skiers in the immediate area.

Other advantages and meritorious features of the present invention will be more fully understood from the following description of the drawings and the preferred embodiments, the appended claims and the drawings which are described hereinbelow.

BRIEF DESCRIPTION OF THE DRAWINGS

FIG. 1 is a fragmentary top plan view of the ski light attachment device of the present invention positioned on the tip of a ski;

FIG. 2 is a fragmentary side view of the installed ski light attachment device of FIG. 1;

FIG. 3 is a fragmentary front view of the ski light attachment device of FIG. 1; and FIG. 4 is a fragmentary perspective view, partially exploded, of an alternate embodiment of a ski light attachment device of the present invention wherein the light is an integral unit which may be selectively secured to or removed from the mounting apparatus.

DESCRIPTION OF THE PREFERRED EMBODIMENT

FIG. 1 shows a ski 11 having the ski light attachment device 13 of the present invention removably secured to the forward portion or tip 15 thereof. The ski attachment device 13 includes a sheath portion 17, a battery-powered, switch-operated light assembly 19, and a light housing or mounting means 21.

The sheath portion 17 is generally U-shaped when viewed from above and is adapted to slip over the ski tip 15. The sheath 17 has its bottom surface 23, its upper surface 25, its side surfaces or edges 27 and its forward end or tip 29 closed and its rearward end 31 opened to receive the ski tip 15 through the open end 31 so that the closed portions 23, 25, 27 and 29 generally conform to the shape of the ski tip 15 when the sheath 17 is correctly fitted over the tip 15. It will, of course, be understood that the configuration of the sheath 17 may be varied so long as it can be receivably retained over the ski tip 15 and, for example, the forward tip 19 and a portion of the edges 27 could be opened if desired or the bottom surface 23 could be generally opened so long as the sheath 17 is adapted to be retained in a proper position over the tip 15.

The upper surface 25 of the sheath 17 may be provided with a flange portion 33 having one or more apertures therein. The apertures are adapted to receive screws 35 although any similar fastening means such as oneway barbs or the like can be used for retainably securing the sheath 17 upon the ski tip 15 so as to prevent accidental loss and to deter theft. Any type of conventional fastening means may be used, but in the preferred embodiment, it is desired to have a fastening means which will allow the ski light attachment device 13 of the present invention to be quickly and easily removed and installed as the skier desires.

The light assembly 19 of the preferred embodiment of the present invention includes a battery 37, such as a typical 1.5 volt DC battery, a light bulb 39 adapted for use with such a battery 37, a circuit, not shown but conventionally known for electrically interconnecting the battery 37 with the bulb 39, and a manually-operable switching element 41 interposed in said circuit for selectively making or breaking the circuit path between the battery 37 and the bulb 39 for turning the light bulb 39 on and off.

In the preferred embodiment of FIGS. 1, 2 and 3, the light assembly 19 including the battery 37, the bulb 39, the electrical circuitry associated therewith and the switch 41 is retained, preferably in a water-tight manner within a generally cylindrical housing 43. The housing 43 is integral with and disposed upon the top surface 25 of the sheath 17 and it has its longitudinal axis aligned with the longitudinal axis of the ski 11. The light assembly 19 is protectively retained within the housing 43 such that the light bulb 39 is disposed adjacent the front end 45 of the housing 43 just above the front edge 29 of the ski tip 15.

The front end 45 of the housing 43 includes a generally cupped, hood-like extension or portion 47 which is shaped to direct a majority of the light, approximately 90% or more of the illumination generated by the bulb 39 in a generally forward direction as indicated by the light rays 49 so as to light the area in front of the ski tips 15 for some predetermined distance depending upon the type of bulb 39 and battery 37 used. In the preferred embodiment of the present invention, the forward illumination 49 was effective at distances of three to six feet using an ordinary penlight battery.

The hood portion 47 of the front end 45 of the housing 43 may also be provided with a slot or alignment aperture 51 which is disposed so as to direct a small percentage of the light, as indicated by the light rays 53 rearwardly and upwardly so that the skier is able to observe his ski tips 15 at all times and is thus better able to align his ski tips for better and safer skiing.

The protective hood 47 directs approximately 90 to 95% of the illumination generated by the light 39 in a forward direction to light the path in front of the ski tip and the alignment port or aperture 51 directs approximately 5 to 10% of the illumination generated by the light back to the skier for alignment purposes.

In operation, a skier utilizing the ski light attachment device 13 of the preferred embodiment herein disclosed will be able to see, even at night or under less than ideal lighting conditions, a short distance in front of his ski tips in order to allow him to choose the best path and avoid accidents. Additionally, he will be able to monitor the tips of his skis at all times for ski alignment and safety purposes. This is particularly useful while cross-country skiing but can also be used in other types of skiing even where the slopes are normally lighted.

Additionally, the use of the ski light attachment device 13 of the present invention enables other skiers not equipped with such devices to be able to see the approach of a skier equipped with the present invention and monitor his progress so that safer overall conditions will exist on the slopes. Additionally, the lighted effect achieved by the ski attachment devices 13 of the present invention is decorative and greatly enhances the aesthetic appearance of a skier coming down the slopes or the like.

FIG. 4 shows an alternate embodiment of the present invention in which the upper surface 25 of the sheath 17 is provided with an abbreviated housing portion 61 which provides only a shallow recess 63 therein. The light assembly 19 is an integral, commercially available unit frequently referred to as a penlight flashlight which includes a similar battery 37, light bulb 39 and switch 41 as previously described. The integral unit is self-contained and has a narrow aperture 65 at its forward end for the passage of light therefrom.

The integral light assembly 19 is adapted to be received into the shallow recess 63 of the abbreviated housing 61 and to be removeably mounted therein by means of a strap or elastic band 67 or some other conventionally known fastening means such that the integral light unit 19 may be retainably mounted to or removed from the housing 63, 67 as desired by the skier.

Additionally, a hooded arrangement could be provided over the tip 29 of the sheath 17 so as to direct the major portion of the light forward of the tip and a small portion back to the skier for tip alignment and safety reasons if desired.

In the preferred embodiment of the present invention, the sheath 17 together with the housing 43 can be integrally molded as a single unitary piece of plastic material such as polyethylene or the like although any suitable material could be used. A lightweight construction of the ski light attachment device 13 of the present invention is desirable in that it will not affect the normal balance of the skis. While specific means have been disclosed for securing the device 13 to the ski tip 15, it will be understood that any means for mechanically fastening the apparatus 13 to the ski tip 15 may be used and although the preferred embodiment discloses an attachment means whereby the units 13 may be readily removable, it will be understood that the units could be permanently fastened to or enclosed within the ski tips 15 themselves if desired.

While this detailed description of the specific apparatus is used to illustrate the present invention and the operation thereof, it will be obvious to those skilled in the art that various modifications can be made without departing from the spirit and scope of the present invention which is limited only by the appended claims.

I claim:

1. A ski attachment comprising a generally U-shaped sheath adapted to be receivably retained over the tip of a ski, said sheath having a closed end at the bight of the U-shaped section and an open portion at its opposite end, the interior of said sheath being shaped to conform to the shape of said ski tip such that when said ski tip is inserted through said open portion, the tip of said ski is disposed against the closed end of said sheath and portions of the surfaces of said ski immediately adjacent said ski tip are disposed snugly against the sloped interior of said sheath for retaining said sheath thereon, a battery-powered electric light and means for mounting said light on said sheath so as to aid the skier during periods when sufficient illumination is not available, said mounting means including a protective housing integral with said sheath and disposed adjacent the upper surface thereof for protectively housing said light.

2. The ski attachment of claim 1 wherein said light is an integral, self-contained unit adapted to be removeably retained within said mounting means.

3. The ski attachment of claim 1 wherein said protective housing includes a light-directing hood disposed at the forward end thereof for directing a major portion of the illumination generated by said light in a forward direction to light the path for a short distance in front of said ski tip.

4. The ski attachment of claim 3 wherein said protective hood includes an alignment port adapted to direct a small percentage of the illumination generated by said light in a generally upward and rearward direction so that the skier can more readily observe the ski tip for alignment purposes.

5. The light attachment of claim 4 wherein said protective hood directs approximately 90 to 95% of the illumination generated by said light in a forward direction to light the path in front of the ski tip and said alignment ports directs approximately 5 to 10% of the illumination generated by said light back to said skier for alignment purposes.

6. The ski attachment of claim 3 wherein said protective housing has its rearward portion closed to protect said light from ice and snow, wherein said light includes a manually operable switch and wherein said housing includes an aperture in an accessible portion of said housing through which said switch operably protrudes.

7. The ski attachment of claim 3 further including means for removably securing said sheath to said ski tip to prevent accidental separation and to reduce the chance of theft.

8. The ski attachment of claim 3 wherein said sheath has its forward end and the upper, lower and edge surfaces adjacent thereto closed so as to completely enclose said ski tip.

9. The ski attachment of claim 3 wherein said sheath and housing comprise a unitary lightweight, integrally-formed plastic construction and said light is receivably retained within said housing in a water-tight manner.

10. In a ski having a forward ski tip, the improvement comprising a battery-powered means for generating light and means for mounting said light-generating means to said forward ski tip so as to direct light forwardly thereof, said mounting means including an alignment aperture, said light generating means being located adjacent said aperture which directs a small portion of the light upwardly and rearwardly toward the skier so that the skier is able to monitor the position of the ski tip for alignment and safety purposes.

11. The improved ski of claim 10 wherein said mounting means includes an integrally-formed plastic sheath adapted to be retainably received over said ski tip, said sheath including an integral portion adjacent the top thereof for protectively housing said light-generating means.

12. The improved ski of claim 11 wherein said integral housing portion includes a hood-like extension for directing the major portion of said generated light in said forward direction, said alignment aperture being located in said hood-like extension for directing a smaller portion of said generated light upwardly and rearwardly.

* * * * *